US010829342B2

(12) United States Patent
Pasini et al.

(10) Patent No.: US 10,829,342 B2
(45) Date of Patent: Nov. 10, 2020

(54) OPERATIONAL MODES FOR MULTICAR HOISTWAY SYSTEMS

(71) Applicant: Otis Elevator Company, Farmington, CT (US)

(72) Inventors: Jose Miguel Pasini, Avon, CT (US); David Ginsberg, Granby, CT (US); Arthur Hsu, South Glastonbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 581 days.

(21) Appl. No.: 15/547,929

(22) PCT Filed: Feb. 2, 2016

(86) PCT No.: PCT/US2016/016141
§ 371 (c)(1),
(2) Date: Aug. 1, 2017

(87) PCT Pub. No.: WO2016/126688
PCT Pub. Date: Aug. 11, 2016

(65) Prior Publication Data

US 2018/0022574 A1 Jan. 25, 2018

Related U.S. Application Data

(60) Provisional application No. 62/112,364, filed on Feb. 5, 2015.

(51) Int. Cl.
*B66B 1/24* (2006.01)
*B66B 11/04* (2006.01)
(Continued)

(52) U.S. Cl.
CPC ..... *B66B 1/2466* (2013.01); *B66B 1/28* (2013.01); *B66B 9/003* (2013.01);
(Continued)

(58) Field of Classification Search
CPC ..... B66B 1/2466; B66B 1/28
(Continued)

(56) References Cited

U.S. PATENT DOCUMENTS 4,129,199 A * 12/1978 MacDonald ..... B66B 1/20 187/387
5,393,941 A 2/1995 Mizuno et al.
(Continued)

FOREIGN PATENT DOCUMENTS

CN 1154338 A 7/1997
CN 102123931 A 7/2011
(Continued)

OTHER PUBLICATIONS

Chinese First Office Action for application CN 201680008980.7, dated Dec. 21, 2018, 12 pages.
(Continued)

*Primary Examiner* — David S Warren
(74) *Attorney, Agent, or Firm* — Cantor Colburn LLP

(57) ABSTRACT

A ropeless elevator system (10) includes a plurality of elevator cars (14) configured to travel in a hoistway having at least one lane (13, 15, 17), a propulsion system (16, 18) to impart force to each elevator car of the plurality of elevator cars, and a controller (46). The controller is configured to operate in an in-group mode where the plurality of elevator cars perform service demands, and to selectively operate in an out-of-group mode where at least one selected elevator car of the plurality of elevator cars performs a predetermined task and is prevented from performing the in-group mode service demands.

20 Claims, 11 Drawing Sheets

(51) Int. Cl.
*B66B 11/00* (2006.01)
*B66B 1/28* (2006.01)
*B66B 9/00* (2006.01)

(52) U.S. Cl.
CPC ..... *B66B 11/0005* (2013.01); *B66B 11/0045* (2013.01); *B66B 11/0407* (2013.01); *B66B 2201/223* (2013.01); *B66B 2201/405* (2013.01)

(58) Field of Classification Search
USPC ..... 187/247
See application file for complete search history.

(56) References Cited

U.S. PATENT DOCUMENTS 5,501,295 A * 3/1996 Muller ..... B66B 9/00 187/403
5,773,772 A 6/1998 McCarthy et al.
5,883,343 A * 3/1999 MacDonald ..... B66B 1/20 187/380
2016/0167920 A1* 6/2016 Freeman ..... B66B 1/2458 187/384
2016/0221791 A1* 8/2016 Berryhill ..... B66B 1/468
2016/0251198 A1* 9/2016 Salmikuukka ..... B66B 1/2458 187/388
2016/0376122 A1* 12/2016 Van Dijk ..... B66B 1/2466 187/247
2017/0327345 A1* 11/2017 Steinhauer ..... B66B 5/02
2018/0022573 A1* 1/2018 Hsu ..... B66B 5/0087 187/247
2018/0022574 A1* 1/2018 Pasini ..... B66B 11/0407 187/247
2019/0012864 A1* 1/2019 Yamine ..... B66B 1/468
2020/0031611 A1* 1/2020 Mahoney ..... B66B 1/2408

FOREIGN PATENT DOCUMENTS

CN 102701030 A 10/2012
EP 1367018 A2 12/2003
JP 2000063058 A 2/2000
WO 2011029479 A1 3/2011
WO 2014158127 A1 10/2014
WO 2014182284 A1 11/2014

OTHER PUBLICATIONS

International Search Report and Written Opinion for application PCT/US2016/016141, dated Jul. 19, 2016, 20pgs.

* cited by examiner

OPERATIONAL MODES FOR MULTICAR HOISTWAY SYSTEMS

FIELD OF INVENTION

The subject matter disclosed herein relates generally to the field of elevators, and more particularly to operational modes for ropeless elevator systems.

BACKGROUND

Self-propelled elevator systems, also referred to as ropeless elevator systems, are useful in certain applications (e.g., high rise buildings) where the mass of the ropes for a roped system is prohibitive and there is a desire for multiple elevator cars to travel in a single lane. There exist self-propelled elevator systems in which a first lane is designated for upward traveling elevator cars and a second lane is designated for downward traveling elevator cars. A transfer station at each end of the hoistway is used to move cars horizontally between the first lane and second lane.

BRIEF DESCRIPTION OF THE INVENTION

According to one embodiment of the invention, a ropeless elevator system is provided. The ropeless elevator system includes a plurality of elevator cars configured to travel in a hoistway having at least one lane, a propulsion system to impart force to each elevator car of the plurality of elevator cars, and a controller. The controller is configured to operate in an in-group mode where the plurality of elevator cars perform service demands, and to selectively operate in an out-of-group mode where at least one selected elevator car of the plurality of elevator cars performs a predetermined task and is prevented from performing the in-group mode service demands.

In addition to one or more of the features described above, or as an alternative, further embodiments may include: wherein the propulsion system is a linear propulsion system comprising a primary portion mounted in the hoistway, the primary portion comprising a plurality of motor segments, and a plurality of secondary portions, wherein at least one secondary portion of the plurality of secondary portions is mounted to one elevator car of the plurality of elevator cars; wherein the hoistway is partially constructed and is configured for use in a building under construction; wherein in the out-of-group mode the controller is programmed to reserve at least two designated, non-overlapping areas on the hoistway, allow elevator car traffic that must go through the designated area to serve the service demands assigned thereto prior to switching to the out-of-group mode, and direct at least one selected car to each designated area of the at least two designated areas; wherein in the out-of-group mode the controller is programmed to receive schedule information for future use of the elevator system, and devise, based on the received schedule information, a predefined path for the at least one selected elevator car such that the at least one selected elevator car meets a demand of the future use with minimal conflict between selected elevator cars; wherein in the out-of-group mode the controller is further programmed to announce the beginning of the future use, and move the at least one selected elevator car to a predetermined start position; wherein in the out-of-group mode the controller is programmed to assign a specific task to the at least one selected elevator car, receive information regarding operational constraints and capabilities of the at least one selected elevator car assigned to the specific task, and perform the specific task by operating the at least one selected elevator car in a predetermined manner within the received operational constraints and capabilities; wherein the at least one selected elevator car is at least one of a winch car having a winch configured to pull a load, a container car configured to couple to a load, a long object puller configured move an object hanging beneath the long object puller, and an elevator car having elongated secondaries; wherein the at least one selected elevator car is at least two selected elevator cars, and wherein in the out-of-group mode the controller is programmed to assign a specific task to the at least two selected elevator cars, move the at least two selected elevator cars to a preparation area such that the at least two selected elevator cars can be prepared to perform the specific task, and perform the specific task by simultaneously operating the at least two selected elevator cars in collaboration and in a predetermined manner within the received operational constraints and capabilities; wherein the specific task is moving a load horizontally; wherein the at least one lane is a plurality of lanes, and wherein in the out-of-group mode the controller is programmed to define a one-way circulation path around the plurality of lanes, the one-way circulation path configured to move the at least one selected elevator car in an upward direction, a horizontal direction, and a downward direction, and assign the at least one selected elevator car to the one-way circulation path for circulation exclusively therein during at least a portion of the out-of group mode; and/or wherein in the out-of-group mode the controller is further programmed to selectively remove the at least one selected elevator car from the one-way circulation path to serve a demand at a location that is not on the one-way circulation path, and return the at least one selected elevator car to the one-way circulation path after the demand has been served.

According to another embodiment of the invention, a method of controlling a ropeless elevator system comprising a plurality of elevator cars configured to travel in a hoistway having at least one lane and a propulsion system to impart force to each elevator car of the plurality of elevator cars is provided. The method includes operating in an in-group mode where the plurality of elevator cars perform service demands, and selectively operating in an out-of-group mode where at least one selected elevator car of the plurality of elevator cars performs a predetermined task and is prevented from performing the in-group mode service demands.

In addition to one or more of the features described above, or as an alternative, further embodiments may include: wherein operating in the out-of-group mode further comprises reserving at least two designated areas on the hoistway, allowing elevator car traffic that must go through the designated area to serve the service demands assigned thereto prior to switching to the out-of-group mode, and directing at least one selected car to each designated area of the at least two designated areas; wherein operating in the out-of-group mode further comprises receiving schedule information for future use of the elevator system, and devising, based on the received schedule information, a predefined path for the at least one selected elevator car such that the at least one selected elevator car meets a demand of the future use with minimal conflict between selected elevator cars; wherein operating in the out-of-group mode further comprises assigning a specific task to the at least one selected elevator car, receiving information regarding operational constraints and capabilities of the at least one selected elevator car assigned to the specific task, and performing the specific task by operating the at least one selected elevator car in a predetermined manner within the received operational constraints and capabilities; wherein the at least one selected elevator car is at least two selected elevator cars, and wherein operating in the out-of-group mode comprises assigning a specific task to the at least two selected elevator cars, moving the at least two selected elevator cars to a preparation area such that the at least two selected elevator cars can be prepared to perform the specific task, and performing the specific task by simultaneously operating the at least two selected elevator cars in collaboration and in a predetermined manner within the received operational constraints and capabilities; wherein the at least one lane is a plurality of lanes, and wherein operating in the out-of-group mode comprises defining a one-way circulation path around the plurality of lanes, the one-way circulation path configured to move the at least one selected elevator car in an upward direction, a horizontal direction, and a downward direction, and assigning the at least one selected elevator car to the one-way circulation path for circulation exclusively therein during the out-of group mode; and/or wherein operating in the out-of-group mode further comprises selectively removing the at least one selected elevator car from the one-way circulation path to serve a demand at a location that is not on the one-way circulation path, and returning the at least one selected elevator car to the one-way circulation path after the demand has been served.

According to another embodiment of the invention, a method of controlling a ropeless elevator system comprising a plurality of elevator cars configured to travel in a hoistway having a plurality of lanes and a propulsion system to impart force to each elevator car of the plurality of elevator cars is provided. The method includes operating in an in-group mode where the plurality of elevator cars perform service demands, and selectively operating in a first out-of-group mode, a second out-of-group mode, a third out-of-group mode, a fourth out-of-group mode, and a fifth out-of-group mode where at least one selected elevator car of the plurality of elevator cars performs a predetermined task and is prevented from performing the in-group mode service demands. Operating in the first out-of-group mode comprises reserving at least two designated areas on the hoistway, allowing elevator car traffic that must go through the designated area to serve the service demands assigned thereto prior to switching to the out-of-group mode, and directing at least one selected car to each designated area of the at least two designated areas. Operating in the second out-of-group mode comprises receiving schedule information for future use of the elevator system, and devising, based on the received schedule information, a predefined path for the at least one selected elevator car such that the at least one selected elevator car meets a demand of the future use with minimal conflict between selected elevator cars. Operating in the third out-of-group mode comprises assigning a specific task to the at least one selected elevator car, receiving information regarding operational constraints and capabilities of the at least one selected elevator car assigned to the specific task, and performing the specific task by operating the at least one selected elevator car in a predetermined manner within the received operational constraints and capabilities. Operating in the fourth out-of group mode comprises assigning a specific task to at least two selected elevator cars, moving the at least two selected elevator cars to a preparation area such that the at least two selected elevator cars can be prepared to perform the specific task, and performing the specific task by simultaneously operating the at least two selected elevator cars in collaboration and in a predetermined manner within the received operational constraints and capabilities. Operating in the fifth out-of-group mode comprises defining a one-way circulation path around the plurality of lanes, the one-way circulation path configured to move the at least one selected elevator car in an upward direction, a horizontal direction, and a downward direction, and assigning the at least one selected elevator car to the one-way circulation path for circulation exclusively therein during the out-of group mode.

In addition to one or more of the features described above, or as an alternative, further embodiments may include: a control terminal in signal communication with the controller, the control terminal configured to enable authorized personnel to switch the elevator system between the in-group mode and the out-of-group mode.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Figure 1:
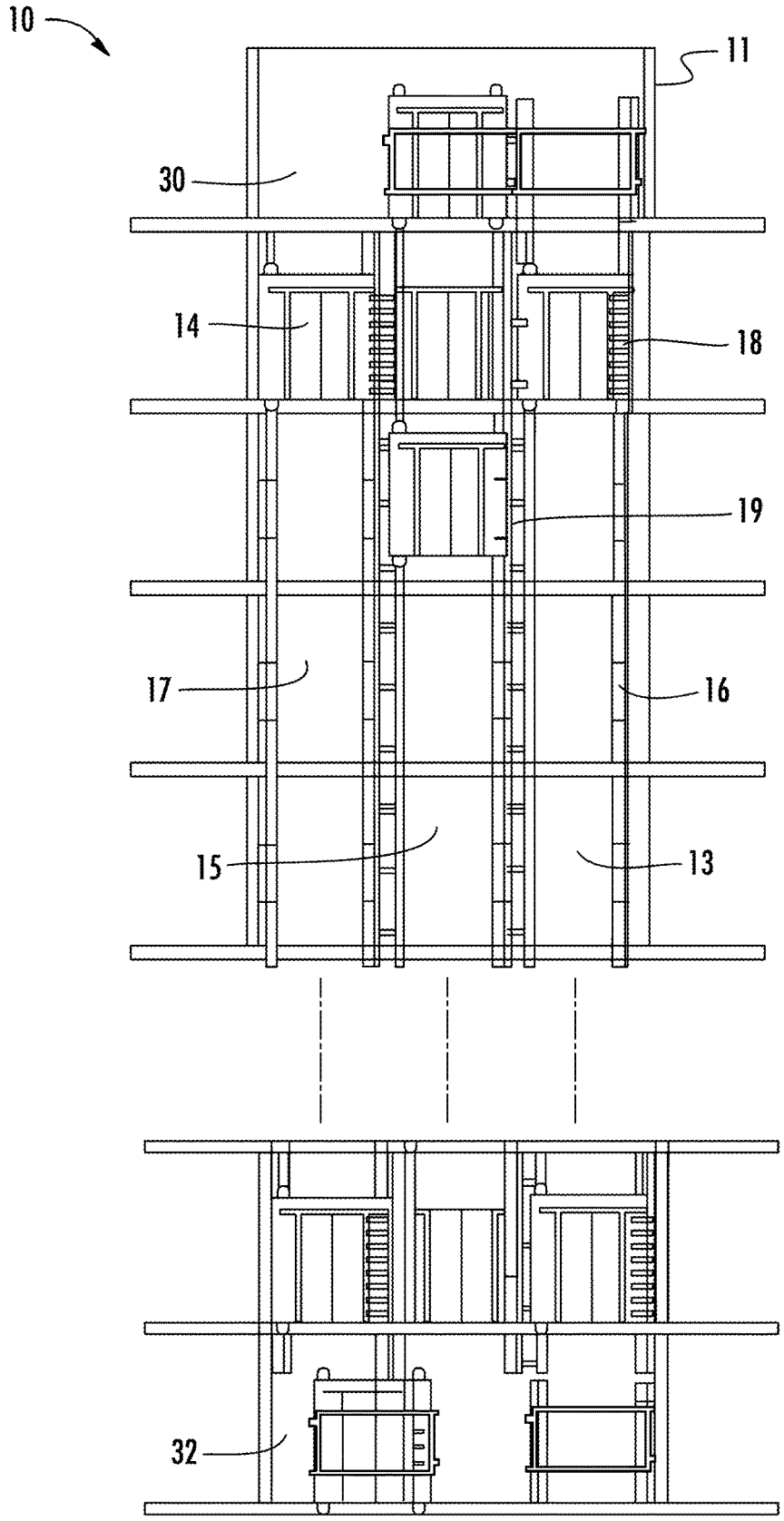
FIG. 1 depicts an multicar ropeless elevator system in accordance with an exemplary embodiment.

FIG. 1 depicts a multicar, propelled ropeless elevator system 10 in an exemplary embodiment. Elevator system 10 includes hoistway 11 having a plurality of lanes 13, 15 and 17. While three lanes are shown in FIG. 1, it is understood that embodiments may be used with multicar, self-propelled elevator systems have any number of lanes. In each lane 13, 15, 17, cars 14 travel in one direction, i.e., up or down. For example, in FIG. 1 cars 14 in lanes 13 and 15 travel up and cars 14 in lane 17 travel down. One or more cars 14 may travel in a single lane 13, 15, and 17. In some embodiments, the cars may travel in more than one direction in a lane.

Above the top floor is an upper transfer station 30 to impart horizontal motion to elevator cars 14 to move elevator cars 14 between lanes 13, 15 and 17. It is understood that upper transfer station 30 may be located at the top floor, rather than above the top floor. Below the first floor is a lower transfer station 32 to impart horizontal motion to elevator cars 14 to move elevator cars 14 between lanes 13, 15 and 17. It is understood that lower transfer station 32 may be located at the first floor, rather than below the first floor. Although not shown in FIG. 1, one or more intermediate transfer stations may be used between the first floor and the top floor. Intermediate transfer stations are similar to the upper transfer station 30 and lower transfer station 32.

Cars 14 are propelled using a linear motor system having a primary, fixed portion 16 and a secondary, moving portion 18. The primary portion 16 includes windings or coils mounted at one or both sides of the lanes 13, 15 and 17. Secondary portion 18 includes permanent magnets mounted to one or both sides of cars 14. Primary portion 16 is supplied with drive signals to control movement of cars 14 in their respective lanes. However, elevator system 10 may include elevator cars 14 propelled in other manners.

Figure 2:
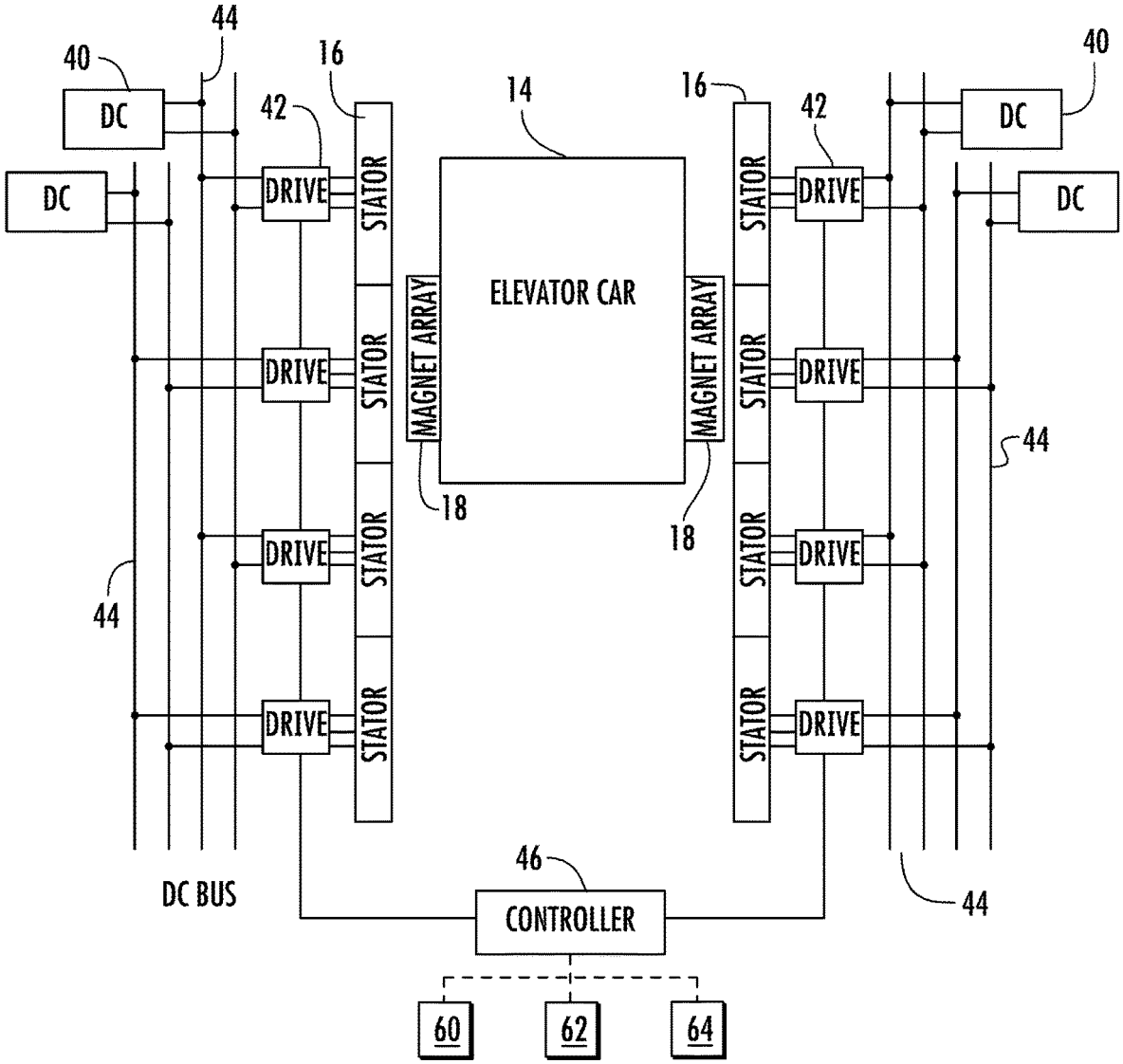
FIG. 2 depicts components of a drive system in an exemplary embodiment.

FIG. 2 depicts components of a drive system in an exemplary embodiment. It is understood that other components (e.g., safeties, brakes, etc.) are not shown in FIG. 2 for ease of illustration. As shown in FIG. 2, one or more DC power sources 40 are coupled to one or more drives 42 via one or more DC buses 44. DC power sources 40 may be implemented using storage devices (e.g., batteries, capacitors) or may be active devices that condition power from another source (e.g., rectifiers). Drives 42 receive DC power from the DC buses 44 and provide drive signals to the primary portion 16 of the linear motor system. Each drive 42 may be a converter that converts DC power from DC bus 44 to a multiphase (e.g., 3 phase) drive signal provided to a respective section of the primary portions 16. The primary portion 16 is divided into a plurality of motor sections, with each motor section associated with a respective drive 42.

A controller 46 provides control signals to the each of the drives 42 to control generation of the drive signals. Controller 46 may use pulse width modulation (PWM) control signals to control generation of the drive signals by drives 42. Controller 46 may be implemented using a processor-based device programmed to generate the control signals. Controller 46 may also be part of an elevator control system or elevator management system.

Figure 3:
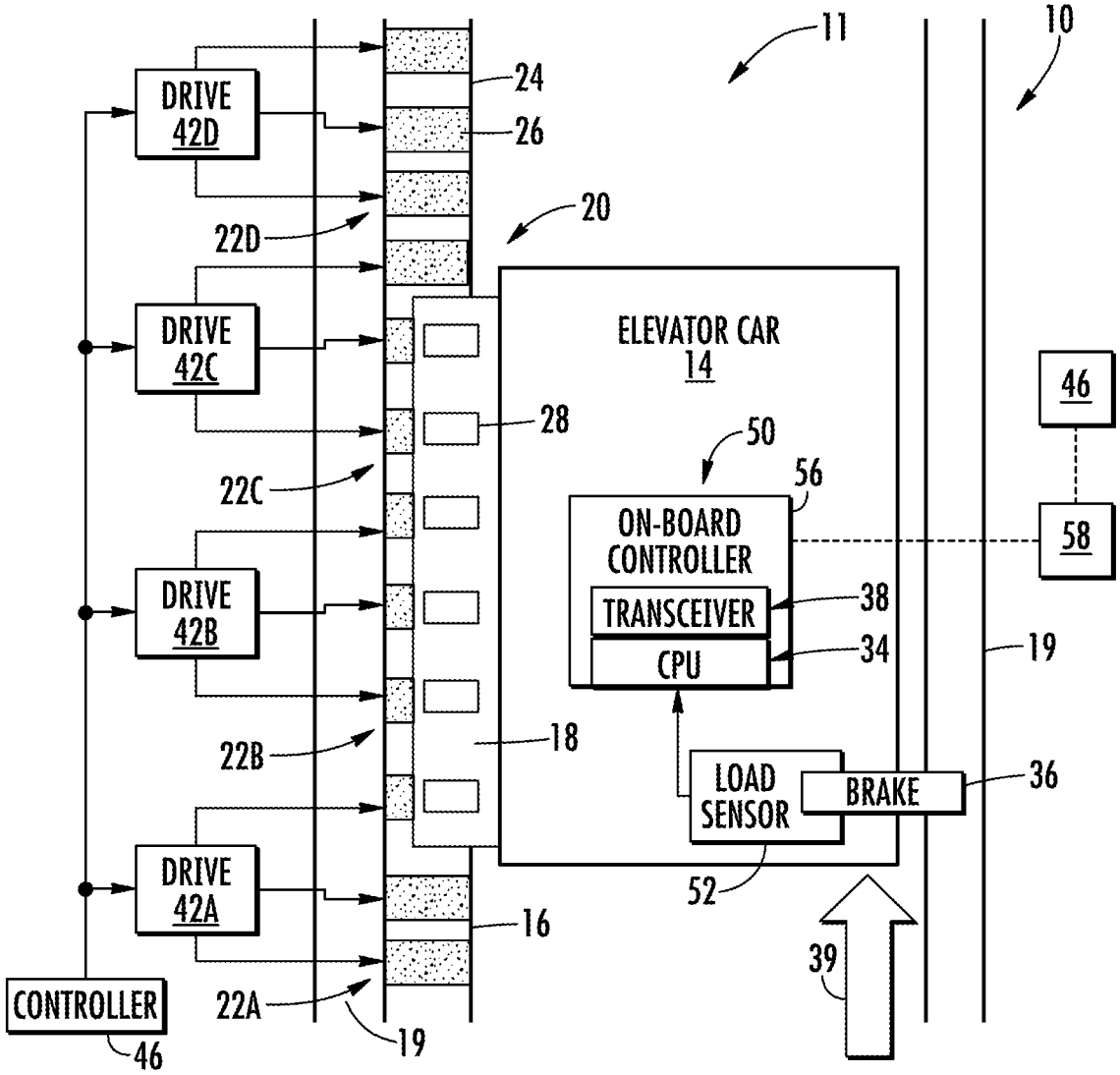
FIG. 3 depicts a portion of the elevator system in accordance with an exemplary embodiment.

FIG. 3 depicts another exemplary view of the elevator system 10 including an elevator car 14 that travels in hoistway 11. In an exemplary embodiment, elevator car 14 is guided by one or more guide rails 24 extending along the length of hoistway 11, where the guide rails 24 may be affixed to structural member 19. For ease of illustration, the view of FIG. 3 only depicts a single guide rail 24; however, there may be two or more guide rails 24 positioned, for example, on opposite sides of the elevator car 14. In an exemplary embodiment, elevator system 10 employs a propulsion system such as a linear propulsion system 20, where primary portion 16 includes multiple motor segments 22 each with one or more coils 26 (i.e., phase windings). Primary portion 16 may be mounted to guide rail 24, incorporated into the guide rail 24, or may be located apart from guide rail 24. Primary portion 16 serves as a stator of a permanent magnet synchronous linear motor to impart force to elevator car 14. In an exemplary embodiment, secondary portion 18 is mounted to the elevator car 14 and includes an array of one or more permanent magnets 28 as a second portion of the linear propulsion system 20. Coils 26 of motor segments 22 may be arranged in three phases, as is known in the electric motor art. One or more primary portions 16 may be mounted in the hoistway 11, to coact with permanent magnets 28 mounted to elevator car 14. The permanent magnets 28 may be positioned on two sides of elevator car 14; although, only a single side of elevator car 14 that includes permanent magnets 28 is depicted in the example of FIG. 3. Alternate embodiments may use a single primary portion 16—secondary portion 18 configuration, or multiple primary portion 16—secondary portion 18 configurations.

In the example of FIG. 3, there are four motor segments 22 depicted as motor segment 22A, motor segment 22B, motor segment 22C, and motor segment 22D. Each of the motor segments 22A-22D has a corresponding drive 42A-42D. A controller 46 provides drive signals to the motor segments 22A-22D via drives 42A-42D to control motion of the elevator car 14. Controller 46 may be implemented using a microprocessor executing a computer program stored on a storage medium to perform the operations described herein. Alternatively, controller 46 may be implemented in hardware (e.g., ASIC, FPGA) or in a combination of hardware/software. Controller 46 may also be part of an elevator control system. Controller 46 may include power circuitry (e.g., an inverter or drive) to power the primary portion 16. Although a single controller 46 is depicted, it will be understood by those of ordinary skill in the art that a plurality of controllers 46 may be used. For example, a single controller 46 may be provided to control the operation of a group of motor segments 22 over a relatively short distance.

In exemplary embodiments, the elevator car 14 includes an on-board controller 56 with one or more transceivers 38 and a processor, or CPU, 34. The on-board controller 56 and the controller 46 collectively form a control system 50 where computational processing may be shifted between the on-board controller 56 and the controller 46. In exemplary embodiments, the processor 34 is configured to monitor one or more sensors and to communicate with one or more controllers 46 via the transceivers 38. In exemplary embodiments, to ensure reliable communication, elevator car 14 may include at least two transceivers 38. The transceivers 38 can be set to operate at different frequencies, or communications channels, to minimize interference and to provide full duplex communication between the elevator car 14 and the one or more controllers 46. In the example of FIG. 3, the on-board controller 56 interfaces with a load sensor 52 to detect an elevator load on a brake 36. The brake 36 may engage with the structural member 19, a guide rail 24, or other structure in the hoistway 11. Although the example of FIG. 3 depicts only a single load sensor 52 and brake 36, elevator car 14 can include multiple load sensors 52 and brakes 36.

Elevator loads observed by the load sensor 52 can be computed locally by the on-board controller 56 or sent wirelessly to the controller 46 via transceiver 38 for further processing. As one example, the on-board controller 56 can stream data from the load sensor 52 in real-time as it is collected. Alternatively, the on-board controller 56 can time stamp or otherwise correlate elevator load data with timing information prior to sending the elevator load data to the controller 46.

Figure 4:
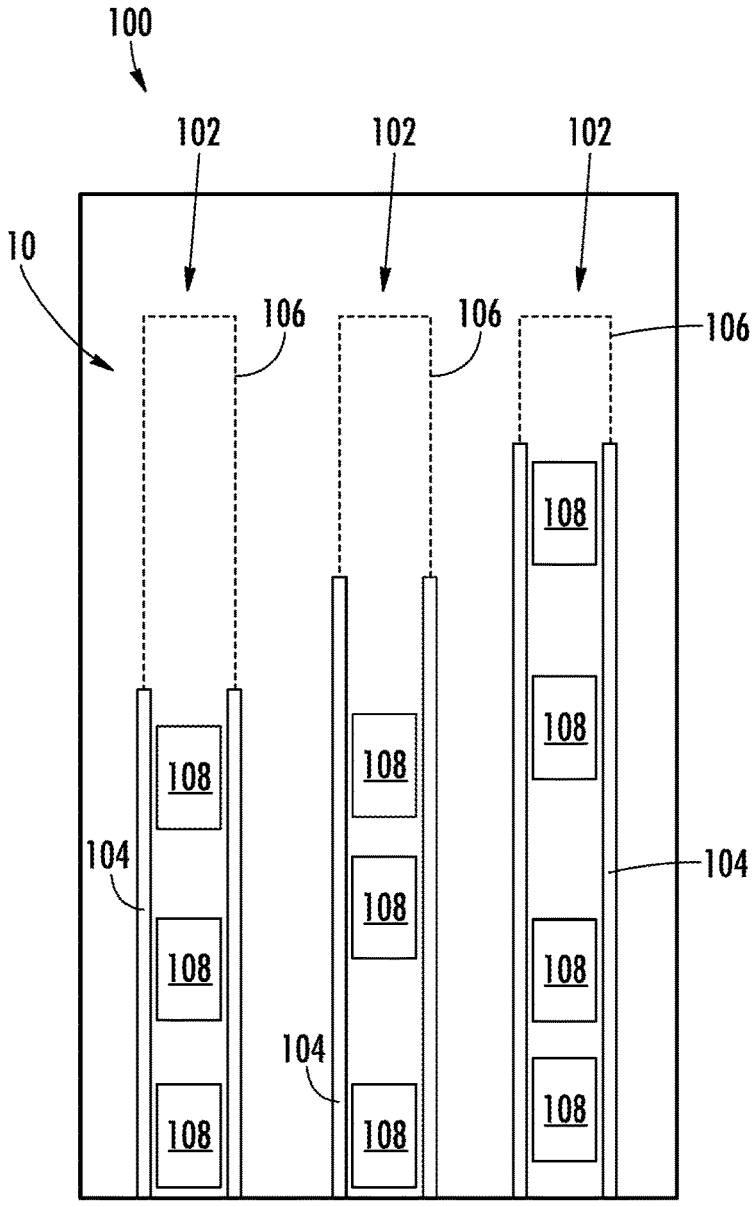
FIG. 4 depicts a multicar ropeless elevator system in accordance with another exemplary embodiment.

During use, elevator system 10 may include one or more operational modes to direct one or more elevator cars 14 to perform a specific task. Such operational modes may be utilized during construction of a building. For example, as shown in FIG. 4, building 100 includes hoistways 102 with incomplete propulsion systems 104 (i.e., not built to completion height as shown by uncompleted portions 106). As such, power is distributed only on a portion of hoistways 102. As illustrated, more than one elevator car 108 shares a hoistway. Users place calls by providing their destination to system 10, which determines which elevator car 108 will serve the demand while ensuring minimum separation between cars 108 to avoid collisions.

Example Elevator System Operation

Elevator system 10 is configured to operate each elevator car 14 in an "in-group" mode or an "out-of-group" mode. An elevator car 14 is in-group when the car is available to serve ordinary traffic demand such as responding to passenger calls. An elevator car 14 is out-of-group when the car is turned off or reserved for some special function that may make it unavailable to serve ordinary traffic. Typically, elevator cars 14 are in-group by default until an authorized user takes the car out of group service.

Elevator system 10 is also configured to operate in a transition mode to transition one or more elevator cars 14 from the in-group mode to the out-of-group mode to meet the specialized demand of the desired out-of-group car operation. This may include preparation of each elevator car 14 for the designated out-of-group operation. This transition mode operation is particularly important in multicar hoistway systems, such as those described herein, due to potential conflicts between multiple, simultaneously operating elevator cars.

During normal use, elevator system 10 operates elevator cars 14 in the in-group mode. For example, a passenger may enter car 14, press a button, and the car subsequently takes the passenger to a building floor associated with the button that was pressed. When switching one or more cars 14 to out-of-group, the transition mode generally includes: (A) initiating (or receiving) an out-of-group request, (B) receiving (or providing) a request acknowledgement and/or information, and (C) providing a car readiness notification that the transition is complete. The out-of-group mode subsequently includes: (D) providing out-of-group controls, and (E) initiating (or receiving) request to leave the out-of-group mode.

(A) Initiating the Out-of-Group Request

Initiating the out-of-group request may further include: (A1) accessing a control terminal, (A2) authentication of an authorized user, (A3) providing related out-of-group selection parameters and options, and (A4) satisfying transition preconditions.

(A1) Accessing Control Terminal

Accessing a control terminal may include accessing a control terminal 58 (FIG. 3) that is in signal communication with controller 46. Control terminal 58 may be one or more kiosks, key switches, keypads, computer terminals, touch screens, audio recognition devices, or the like. Further, control terminal 58 may be located in any suitable location such as in building hallways, in elevator cars, and/or security areas. Control terminal 58 may be a mobile or handheld device or may be located remotely from the building. Control terminal 58 may communicate in any suitable manner such as via a building management system, via wireless, via internet, a Local Area Network (LAN) or Controller Network (which may not be related to other building networks), or the like.

(A2) Authentication of Authorized User

Authentication of an authorized user may include requiring the user to input a login code, engage a key switch, or swipe a keycard to initiate the out-of-group request. However, any suitable method of authentication may be used that enables system 10 to function as described herein. Alternatively, system 10 may not require user authentication.

(A3) Providing Related Out-of-Group Selection Parameters and Options

Providing related out-of-group selection parameters and options generally includes providing parameters/options to enable the user to define the type of out-of-group feature desired for one or more elevator cars 14. For example, a user may be given options to select specific cars, cars of a certain type, or which areas of a lane will be served. In other embodiments, a user may be provided with a selection of predefined out-of-group operational modes, some of which are described herein in more detail. Once an operation for the car is selected, the user may be provided with various sub-options for preparation of the selected option. For example, the user may be provided with "pre-emptive control" option and a "non-pre-emptive control" option. With pre-emptive control, for example, the car ignores all existing demand and requires passengers to immediately exit the car so it may be used as soon as possible. With non-pre-emptive control, for example, the car serves all existing demand (but will not take new demand) before switching to the out-of-group operation. Other specific parameters/options will be described herein in sections related to specific out-of-group operations.

To assist with providing parameter/option information, elevator system 10 may include an interface (e.g., terminal 58, a wireless device, etc.). The interface enables a user to specify various parameters/options related to the selection and control for a specific operation in the out-of-group mode. System 10 may also provide guidance to the user to assist with entering the correct information to perform a desired task or function in the specific out-of-group operation. Such information may include a time estimate of when a car will arrive at a desired location, or checking when a request will be satisfied (e.g., a request status check).

System 10 may also be integrated with an identification device such that each passenger or equipment traveling on cars 14 may be identified (e.g., by RFID tag, face recognition). System 10 may further assist in locating an individual or piece of equipment utilizing the identification device. System 10 may also be able to receive information to assist with providing parameter/option information. For example, a construction schedule may be provided to system 10. Further, system 10 may include a built-in database that includes information about the system, the building, the elevator cars, etc. For example, system 10 may be provided with a database that includes capabilities and constraints of elevator cars for various special operations in the out-of-group mode.

(A4) Satisfying Transition Preconditions

Satisfying transition preconditions includes making sure predefined conditions are satisfied so that the selected elevator car 14 can properly and safely transition to the selected out-of-group operation. The required preconditions may vary depending on the selected type of out-of-group operation and/or the specific car type.

For example, system 10 may require a selected car to be empty (e.g., of passengers) before it can move to a location to begin a selected operation. Other preconditions may include: (a) the controller first allows cars that have already been assigned to traverse a selected range, (b) the controller ensures that any existing demand assigned to the car designated for out-of-group service is served (e.g., non-preemptive operation), (c) the controller ensures that cars not serving the out-of-group operation are moved outside of the selected range, (d) the controller does not assign traffic to a car that would be required to traverse the selected range, (e) the controller commands the designated car to move to the initiation location (note that the controller may need to plan and command the car to come from a different lane), and/or (f) the controller positions in-group cars in preparation before the out-of-group car takes exclusive control of the selected range (for example, the portion of the lane above the selected range may be used for in-group service, but may be isolated from the rest of the system, so the controller may place a predefined number of in-group cars in this portion of the lane before it is blocked off). Only after the defined preconditions are satisfied can the selected cars 14 then proceed to the out-of-group operation.

(B) Receiving Request Acknowledgement and/or Information

Receiving request acknowledgement and/or information may include: (a) receiving acknowledgement of the out-of-group request, (b) receiving denial/approval of the request, and/or (c) providing information related to the out-of-group request. For example, (a) receiving acknowledgement may include an audio or visual signal indicating that the request is approved (e.g., lighting a button), (b) the request may be denied if, for example, granting the request would violate a higher-level constraint such as one that always allows in-group service to some floors, and (c) providing information may include a status of the selected car (e.g., car is powered off, estimated time until car will be ready for specialized operation). Another example of providing status information may occur when a set of steps must be performed during the transition mode, and system 10 may provide the user with information about which step is being performed. The acknowledgement and status information may be provided on a display or audio device whether installed in the elevator/building or a mobile device, and whether local or remote to system 10.

(C) Car Readiness Notification

The car readiness notification that the transition is complete signals or alerts the user that one or more cars 14 are ready for the selected out-of-group service. This may include: (a) a visual, audible, or tactile notification (e.g., text on an interface screen, a bell, or vibration of a handheld device), and (b) a further user authentication. The further user authentication may be required because it may take some time to prepare the elevator car for the out-of-group mode, even if the initial request for the out of group mode was authenticated. During that time, the authorized user may have left the initiation location and it may be undesirable for an unauthorized user to take control of the car.

(D) Providing Out-of-Group Controls

Providing out-of-group controls includes system 10 providing one or more specific series of user interfaces during out-of-group operation. In such cases, the user is provided with control options specific to the designated out-of-group operation.

In addition, during the out-of-group operation, controller 58, 46 may perform the following: (a) assigning new demand without interfering with the selected range of the out-of-group operation, and/or (b) account for required car operational capabilities and constraints when utilizing that selected car for operations.

(E) Initiating an in-Group Return Request

Initiating an in-group return request enables a user to return elevator cars 14 to another operation (e.g., in-group service) once the out-of-group operation is completed. As such, the user may access control terminal 58 to exit the out-of-group service. This may require an additional user authentication step, prompt passengers to exit the car, and/or include a signal that the out-of-group service mode is completed and the car will return to normal in-group service or other operation.

Operational Modes

Figure 5:
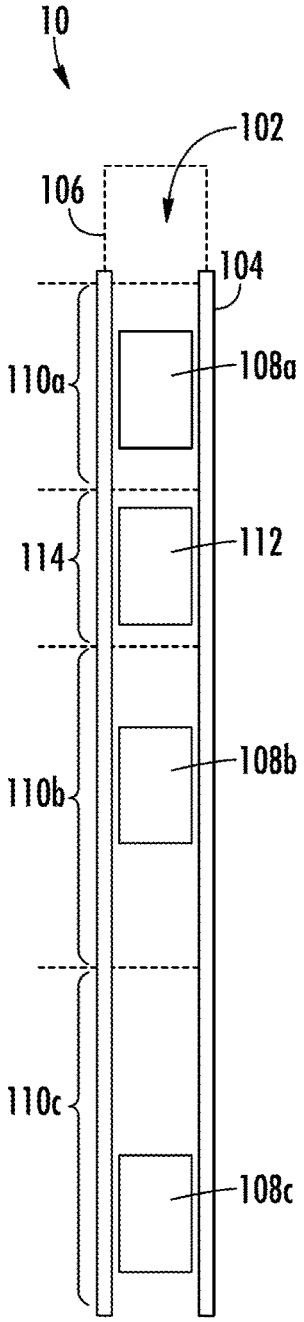
FIG. 5 depicts a multicar ropeless elevator system in accordance with yet another exemplary embodiment.

With reference to FIG. 5, a Multi-zone Mode includes an operation to assign one or more elevator cars 108 to have exclusive operational capacity over multiple reserved, non-overlapping locations or zones 110 within hoistway 102. For example, elevator car 108*a* may be assigned to zone 110*a*, elevator car 108*b* may be assigned to zone 110*b*, and elevator car 108*c* may be assigned to zone 110*c*. Additional or superfluous elevator cars 112 may be temporarily stored in napping areas 114 between zones 110.

Figure 6:
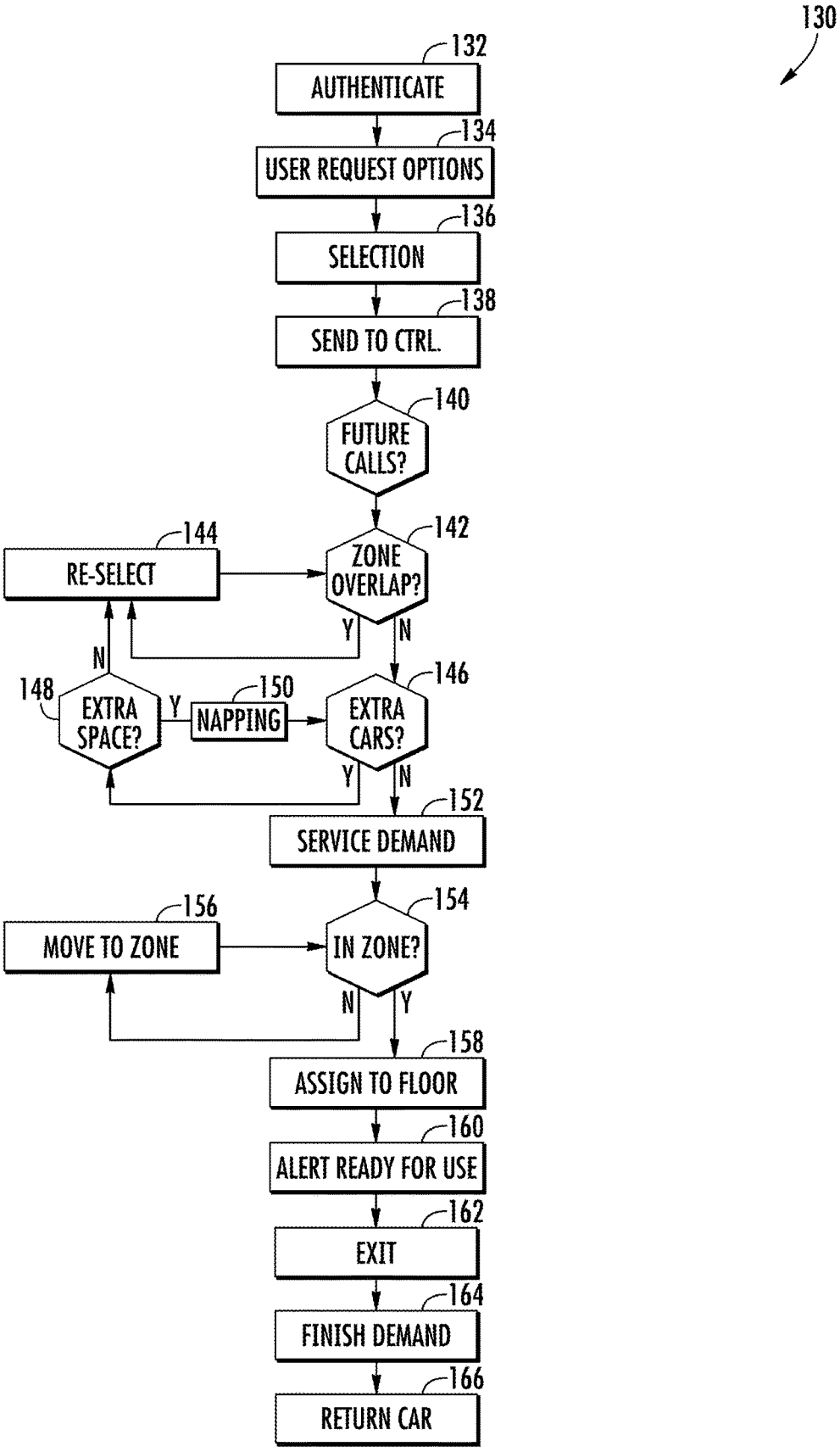
FIG. 6 depicts a control diagram of an exemplary first mode of operation that may be used with the system shown in FIG. 5.

FIG. 6 illustrates an exemplary control method or operation 130 for the Multi-zone Operation. In the exemplary embodiment, control operation 130 optionally includes authorizing and/or authenticating the mode initialization at step 132. For example, a user may be required to input a login code or engage a key switch at control terminal 58 before the Multi-zone Operation is enabled or initialized.

Once enabled, at step 134, user request parameters/options are provided for a desired operation of hoistway 102. The request parameters/options may include, for example: (i) a selection of the range of reserved zones 110; (ii) a selection of elevator cars 108 to be operational within the selected zones 110; and (iii) elevator cars 112 to be excluded from the selected zones 110. At step 136, a desired selection request is determined, for example, by user input into control terminal 58. However, one of the previously described controllers may automatically determine the desired selection request based on predetermined parameters.

At step 138, the elevator car, range, and/or zone selection request may be sent to the controller, which may then determine if future service calls may be made during the operation of the selected Multi-zone Operation at step 140. For example, the controller may internally simulate what happens when the zones are blocked by determining all possible calls, and subsequently determine a trip that can satisfy each call. At step 142, controller 46 may determine if any of the selected zones 110 overlap, and send a signal to control terminal 58 to provide confirmation or denial of the requested operation. If zones overlap, at step 144, a user may be requested to re-select the number of zones 110 and/or the range of each zone.

If the desired operation is confirmed, at step 146, the controller determines if any extra cars 112 exist on hoistway 102 after zones 110 have been selected. If extra cars 112 exist, at step 148, the controller determines if hoistway 102 has any extra space 114 between zones 110 after the zones have been selected. If extra space 114 is absent, control returns to step 144 and zones 110 and their ranges must be re-selected. If extra space exists 114, at step 150, the controller directs extra elevator cars 112 to the determined napping position 114, which may be a specific floor or another lane/hoistway if transfer mechanisms have been installed.

At step 152, if extra cars 112 have the required space 114 or do not exist, the controller directs elevator cars 108, 112 to service any demand that must go through reserved zones 110 and that has already been assigned (e.g., pick up or unload passengers) previous to the initialization of the Multi-zone Operation. At this point, the controller may no longer assign calls to the selected elevator cars 108, 112, and no longer assign any call to elevator cars that must traverse the reserved ranges 110.

At step 154, the controller determines whether the selected elevator cars 108 are in their selected zones 110. If false, the controller directs the selected car 108 to the selected zone 110 at step 156 and returns to step 154. Once cars 108 are located in the desired zones 110, at step 158, the controller assigns each selected car 108 to an initial floor on the reserved range 110. At step 160, the controller may then notify users that the selected cars 108 are available for use within their designated zone 110. Users may then command cars 108 independently within designated zone 110, for example, by pressing buttons on the car operating panel.

To return the selected cars 108, 112 to service, at step 162, the controller generates a signal to exit the Multi-zone Operation (e.g., in response to a user unlock signal, or predetermined time-lapse). At step 164, the controller may direct selected cars 108 to service existing calls, finish with doors open, and signal for the user to exit the car. At step 166, controller 56 may confirm selected cars 108 have been unloaded (e.g., by load-weight sensor 52), and direct selected cars 108 to return to another operational mode (e.g., a normal group service mode).

Figure 7:
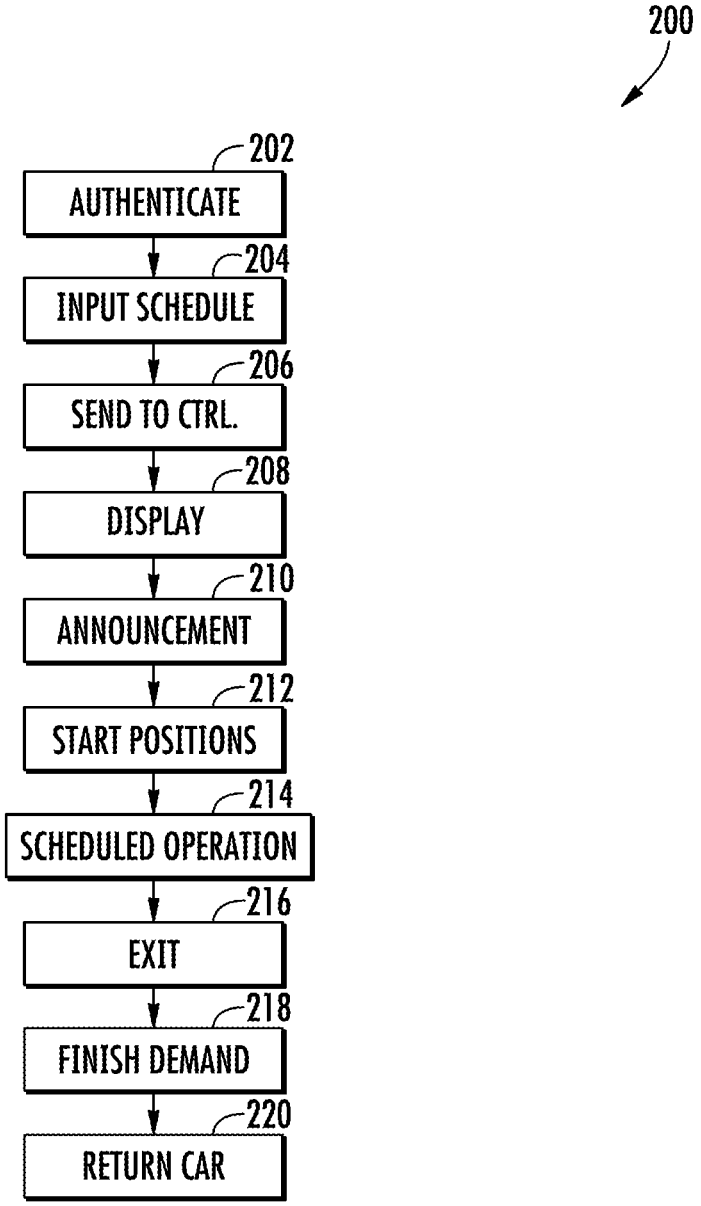
FIG. 7 depicts a control diagram of an exemplary second mode of operation.

With reference to FIG. 7, a Scheduled Operation includes an operation to combine a schedule (e.g., construction schedule) with elevator car dispatching to improve delivery efficiency of people and materials (i.e., reduce delivery time). For example, this mode may be used to schedule normal in-group traffic around time-consuming out-of-group operations for a specific car or set of cars.

FIG. 7 illustrates an exemplary control method or operation 200 for the Scheduled Operation. In the exemplary embodiment, control operation 200 includes authorizing and/or authenticating the mode initialization at step 202. For example, a user may be required to input a login code or engage a key switch at control terminal 58 before the Scheduled Operation is enabled or initialized.

Once enabled, at step 204, a user specifies or inputs a schedule for future use of elevator system 10 that may include elevator car 108 operation information such as timing (e.g., start/end time, duration of use), location (i.e., pickup and drop-off), load (e.g., size, weight), hoistway/lane use, and function (e.g., transport or special use). As such, a user and/or the schedule may provide selection parameters/options related to the operation such as speed of movement, length of time to load (car), length of time to unload (car), deadline for unloading, earliest loading time, preferred loading time, location, special cars, size of cargo, weight of cargo, and/or buffer area around cargo required. The schedule information may be input into control terminal 58. However, one of the previously described controllers may automatically determine the desired selection request based on predetermined parameters.

At step 206, the schedule information may be sent to the controller, and the controller may devise predefined movements for selected elevator cars 108 to meet the scheduled demand with little or no interference or conflict between selected elevator cars 108 that would cause timing delay. At step 208, the controller may display status schedules, schedule conflicts, and suggested schedule adjustments. At step 210, the controller announces the beginning of the Scheduled Operation. This may be, for example, a display on a screen, an audible indicator, or a vibrator, and may include advance notification with an estimated time of arrival.

At step 212, the controller moves elevator cars 108 to predetermined start positions. At step 214, the controller moves elevator cars 108 to their devised scheduled positions at appropriate times throughout the scheduled use. For example, the controller may expect an arrival of a large team that needs to be distributed to specific floors. This may include specific displays showing which team may board which car at any given time. In another example, a car operation may take a longer than usual time, and the controller directs other traffic around the operation. The schedule may also dictate that only a specific subset of floors are required for a given operation.

To return the selected cars 108 to a different service, at step 216, the controller generates a signal to exit the Scheduled Operation (e.g., in response to a user unlock signal, or predetermined time-lapse). At step 218, the controller may direct selected cars 108 to service existing calls, finish with doors open, and signal for the user to exit the car. At step 220, the controller may confirm elevator cars 108 have been unloaded (e.g., by load-weight sensor 52), and direct cars 108 to return to another operational mode (e.g., a normal group service mode).

Figure 8:
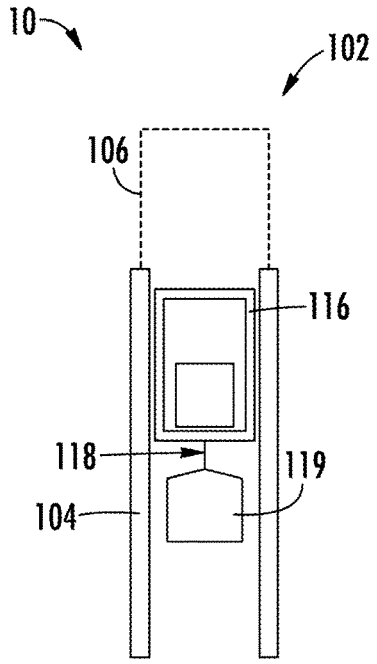
FIG. 8 depicts a multicar ropeless elevator system in accordance with yet another exemplary embodiment.

With reference to FIG. 8, a Special Elevator Car Operation includes operating one or more special elevator cars 116 with special capabilities beyond normal passenger pickup/drop-off. For example, as illustrated, elevator car 116 includes a bottom attachment 118 such that a load 119 can be suspended therefrom. However, special elevator cars may include: winch cars that can pull other weights; container cars having attachment systems that can accept loads in and around the car; long object pullers (long objects suspended beneath or secured on top); and cars with longer secondaries 18 (e.g., longer than a height of the car) that allow the car to move larger loads.

Figure 9:
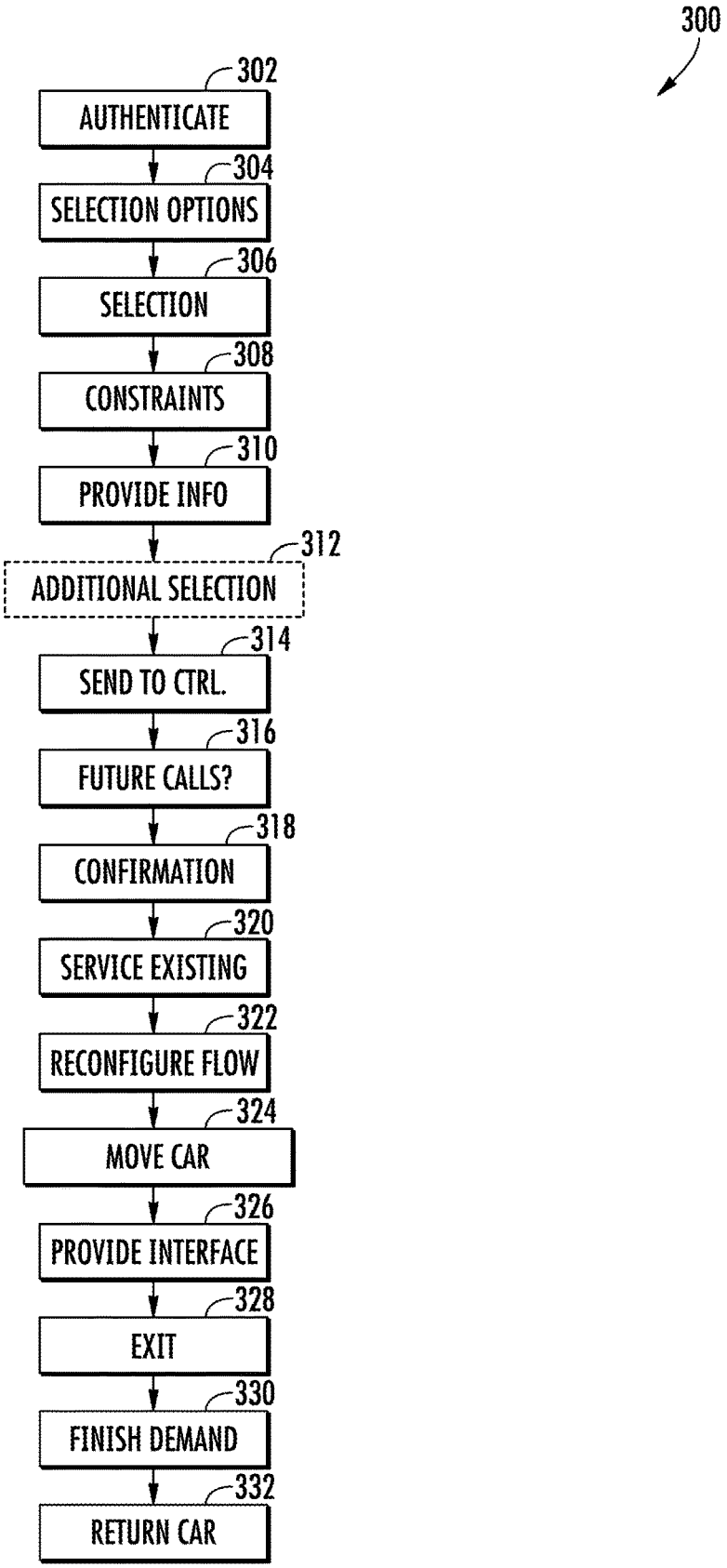
FIG. 9 depicts a control diagram of an exemplary third mode of operation that may be used with the system shown in FIG. 8.

FIG. 9 illustrates an exemplary control method or operation 300 for the Special Elevator Car Operation. In the exemplary embodiment, control operation 300 includes authorizing and/or authenticating the mode initialization at step 302. For example, a user may be required to input a login code or engage a key switch at control terminal 58 before the Special Elevator Car Operation is enabled or initialized.

Once enabled, at step 304, special car selection parameters/options are provided. The selection options may include: (i) a list of special elevator cars 116 and their functions, (ii) a list of functions that may be performed by available special elevator cars 116; and (iii) a list of available special cars 116 and/or functions at a given time. At step 306, a desired selection request is determined, for example, by user input into control terminal 58. However, one of the previously described controllers may automatically determine the desired selection request based on predetermined parameters.

At step 308, controller 46, 58 determines the relevant operational constraints that the selected special cars 116 impose on elevator system 10. For example, a long object puller may require an empty buffer zone (not shown) to be kept around the car to accommodate a long object, or cars may require extra space around the car to account for longer secondaries 18. Also, additional drives 42 may be commanded to distribute power to primaries at a given time, and limitations in the power distribution system may require that special car 116 be operated slowly. Communication and exchange of additional information between the user and car 116 may also be provided during operation of the special car 116 (e.g., a checklist may need to be followed). The controller may include a built-in database of special cars 116 with information that includes the car capabilities and relevant constraints, and/or may include a system for receiving such information.

At step 310, the controller may provide car capability and constraint information for a selected car 116 to the user. This may include additional selection options such as choosing one or more available capabilities of the selected car 116. However, this information may be provided to a separate system such as a construction scheduling program that considers the information when scheduling tasks that do not involve the elevator, but may involve the personnel related to the task. At step 312, if necessary, a desired additional selection request is determined, for example, by user input into control terminal 58.

At step 314, the selection requests may be sent to the controller, which may then determine if future service calls may be made during the operation of the selected Special Elevator Car Mode at step 316. At step 318, the controller may then send a signal to control terminal 58 to provide confirmation or denial of the requested operation. A confirmation may include the ETA of the one or more special elevator cars 116 to a designated area.

If the desired operation is confirmed, at step 320, the controller directs the special car 116 to service any existing demand that has already been assigned (e.g., pick up or unload passengers) previous to the initialization of the Special Elevator Car Operation. At this point, the controller may no longer assign other operational mode calls to the selected elevator car 116.

At step 322, the controller reconfigures the flow pattern of any other elevator cars 14, 108, 116 that may interfere with the operation of the selected special car 116. At step 324, the controller moves the selected car 116 to a desired location. At step 326, the controller may provide an interface to the user for exchange of additional information during the use of the selected special car 116. For example, the controller may provide a checklist or a control panel for retracting or releasing a winch on a winch car. Such additional information or command options may be displayed on control terminal 58, a control screen on car 116, hoistway 11, 102, on a wireless handheld device (not shown), or other device. This may also include audible and tactile indicators.

To return the selected cars 108 to a different service, at step 328, the controller generates a signal to exit the Special Elevator Car Operation (e.g., in response to a user unlock signal, or predetermined time-lapse). At step 330, the controller may direct selected cars 116 to service existing calls, finish with doors open, and signal for the user to exit the car. At step 332, the controller may confirm elevator car 116 has been unloaded (e.g., by load-weight sensor 52), and direct car 116 to return to another operational mode (e.g., a normal group service mode).

Figure 10:
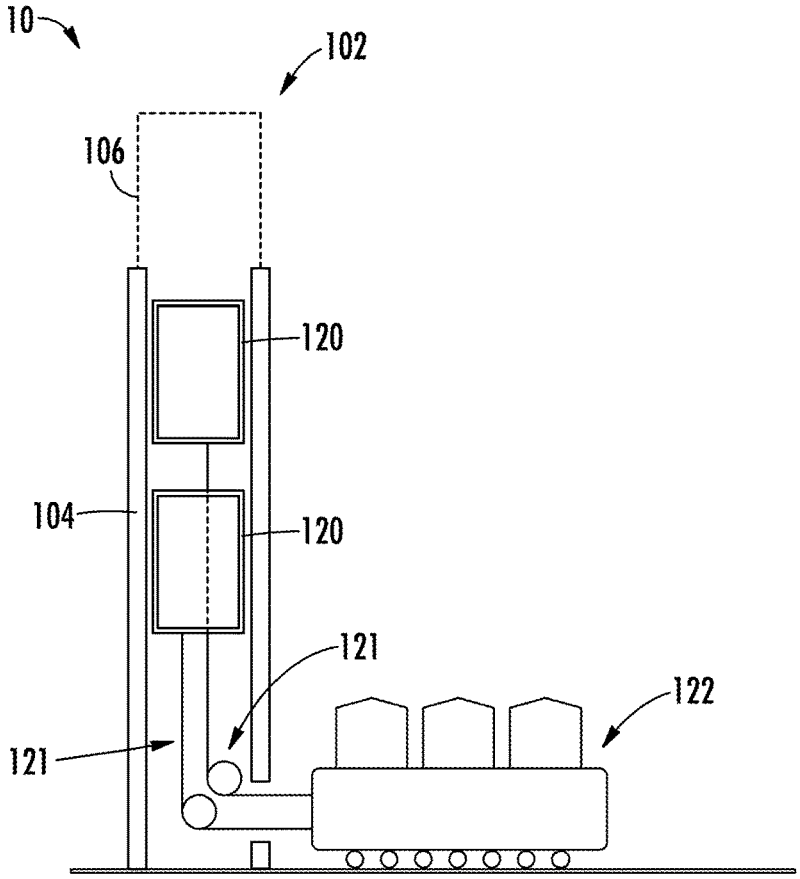
FIG. 10 depicts a multicar ropeless elevator system in accordance with yet another exemplary embodiment.

With reference to FIG. 10, Multicar Collaboration Operation includes operating two or more elevator cars 120 to complete a specific task. For example, as illustrated, elevator cars 120 include attachments 121 (e.g., ropes, pulleys, gears, etc.) coupled to a load 122 outside of hoistway 102. As such, vertical movement of elevator cars 120 may be used to move load 122 horizontally. In another example (not shown), a first elevator car may lift long object, and a second elevator car may be positioned below the first to stabilize the long object to prevent excess swinging.

Figure 11:
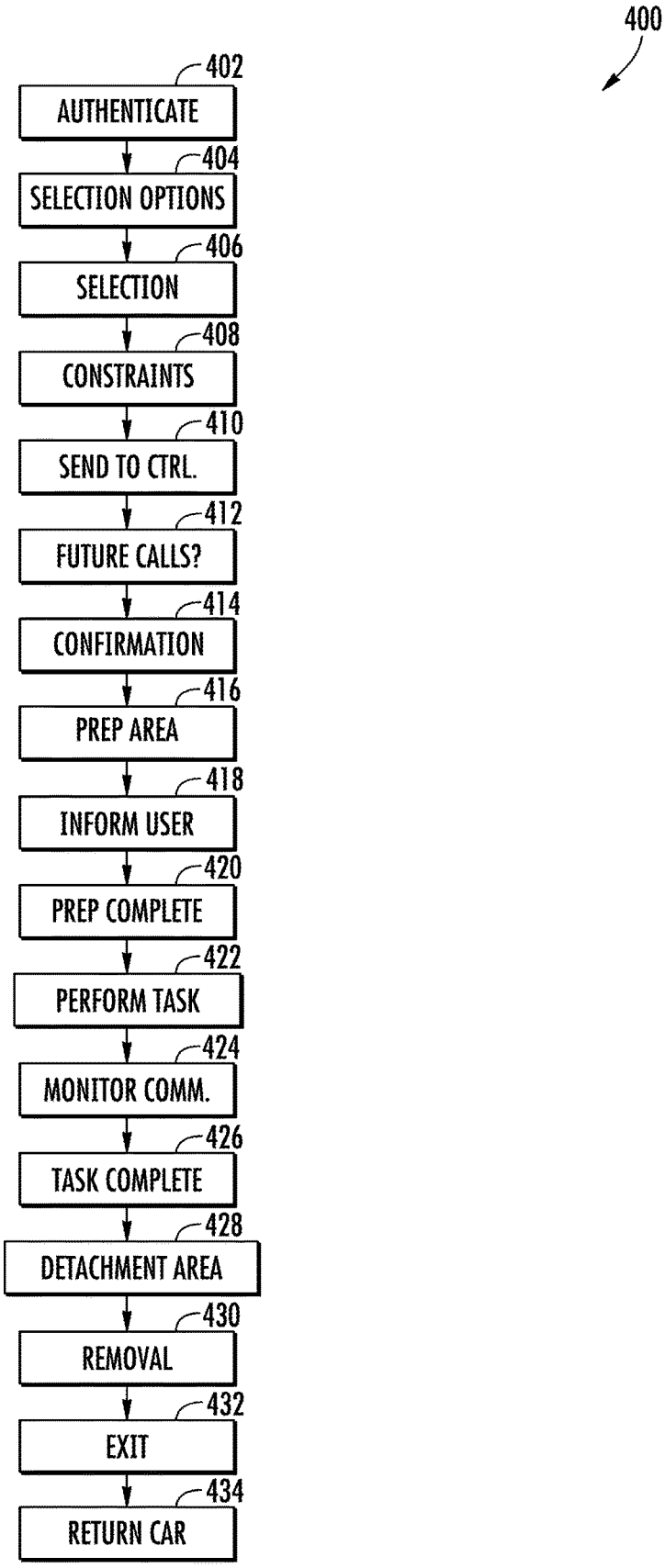
FIG. 11 depicts a control diagram of an exemplary fourth mode of operation that may be used with the system shown in FIG. 10.

FIG. 11 illustrates an exemplary control method or operation 400 for the Multicar Collaboration Operation. In the exemplary embodiment, control operation 400 includes authorizing and/or authenticating the mode initialization at step 402. For example, a user may be required to input a login code or engage a key switch at control terminal 58 before the Multicar Collaboration Operation is enabled or initialized.

Once enabled, at step 404, task selection parameters/options are provided. Such task selection parameters/options may include: (i) which elevator cars 120 will be used to perform the task; (ii) horizontal movement of a load; (iii) vertical movement of a load; (iv) required motion (e.g., single direction, oscillation, manual operation); (v) attachment type (e.g., to determine attachment length or load limits); (vi) initial and final position of the load; (vii) initial positions for cars 120 for coupling and configuration of attachments 121; (viii) special interfaces enabled (e.g., pulling cable health monitors, emergency stop trigger, emergency release trigger). Additionally, the controller may be provided the set of criteria to determine if a task has been completed. This may be based on external signals, including additional sensors. At step 406, a desired task selection request is determined, for example, by user input into control terminal 58. However, one of the previously described controllers may automatically determine the desired selection request based on predetermined parameters.

At step 408, controller 46, 58 determines the relevant constraints that selected cars 120 impose on elevator system 10, as is described herein. The controller may include a built-in database of cars 120 with information that includes the car capabilities and relevant constraints, and/or may include a system for receiving such information.

At step 410, the task selection requests may be sent to the controller, which may then determine if future service calls may be made during the operation of the selected Multicar Collaboration Operation at step 412. At step 414, the controller may then send a signal to control terminal 58 to provide confirmation or denial of the requested operation. A confirmation may include the ETA of the two or more elevator cars 120 to a preparation area.

At step 416, the controller directs elevator cars 120 to the initial preparation area. At step 418, the controller informs the user that cars 120 are positioned for task preparations such as, for example, coupling and configuring attachments 121 between cars 120 and load 122. At step 420, the controller receives confirmation that task preparations are complete. At step 422, the controller moves elevator cars 120 according to the selected task, ensuring the elevator car constraints are being met while the task function is being performed. At step 424, the controller monitors communication between the controller and external devices (not shown) to determine if the task performance should be altered or aborted. The external devices may be additional load sensors, emergency triggers, user communication, etc. At step 426, the controller may receive confirmation by the user that the task is complete. At step 428, the controller directs elevator cars 120 to a detachment area such as the initial preparation area. At step 430, the controller informs the user that cars 120 are positioned for removal of attachments 121.

To return the selected cars 120 to a different service, at step 432, the controller generates a signal to exit the Multicar Collaboration Operation (e.g., in response to a user unlock signal, or predetermined time-lapse). At step 434, the controller may confirm elevator cars 120 have been unloaded (e.g., by load-weight sensor 52), and direct cars 120 to return to another operational mode (e.g., a normal group service mode).

One exemplary operation of the system illustrated in FIG. 10 (horizontal pulling) includes the controller receiving the weight of load 122, characteristics of the attachments 121 (e.g., length and maximum force allowable), the initial and final position of load 122, and the initial positions for cars 120 to couple/configure attachments 121 (step 404). The controller moves both cars 120 to the initial preparation positions and waits for the operator to attach ropes and signal that the task is ready to be performed (step 416). The controller moves both cars 120, controlling both position and force, to ensure rope load limits are not reached, until the final position of load 122 is achieved (step 422). The controller moves both cars 120 to the detachment area (step 428) and informs the user it is safe to remove attachments 121 (step 430).

Figure 12:
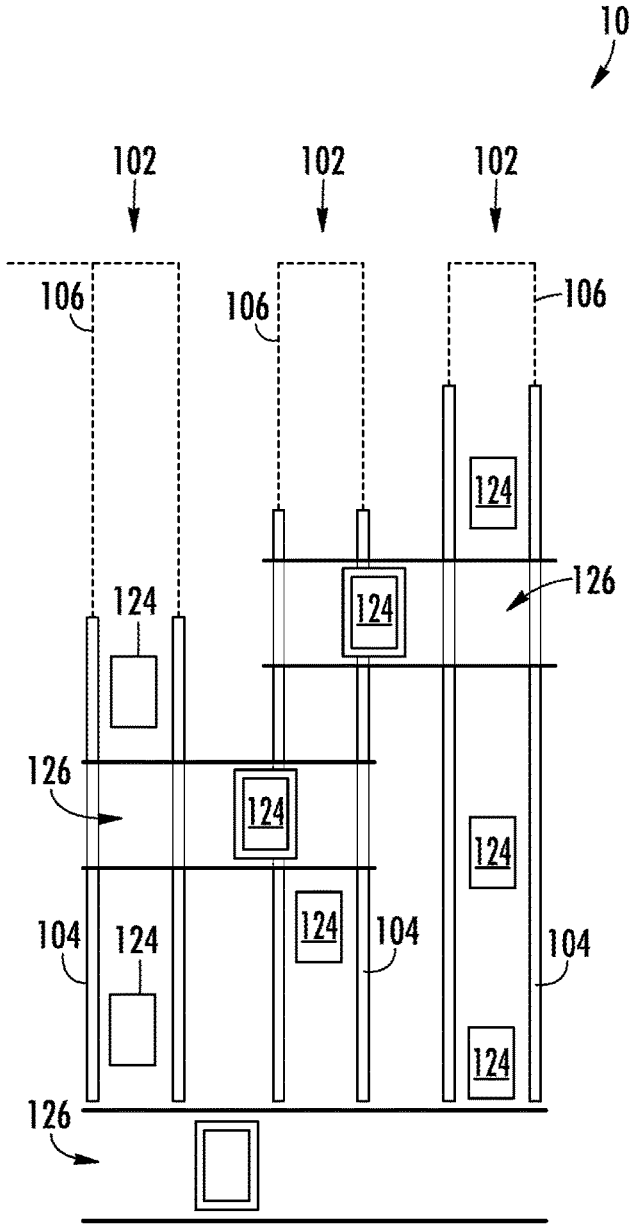
FIG. 12 depicts a multicar ropeless elevator system in accordance with yet another exemplary embodiment.
Figure 13A:
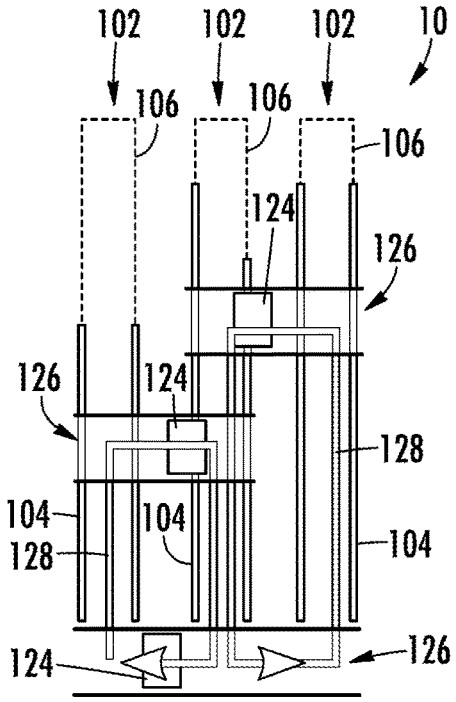
FIG. 13A depicts a multicar ropeless elevator system in accordance with yet another exemplary embodiment.
Figure 13B:
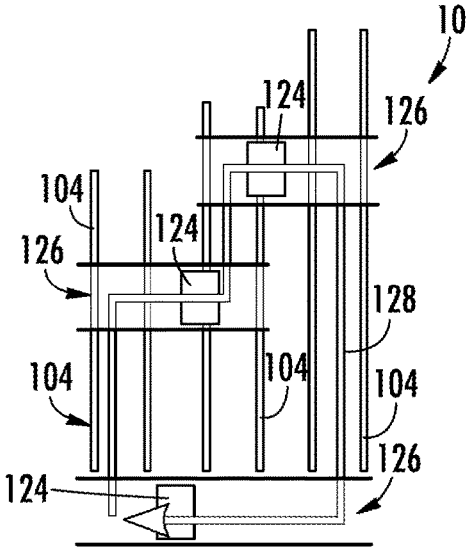
FIG. 13B depicts a multicar ropeless elevator system in accordance with yet another exemplary embodiment.

With reference to FIGS. 12, 13A, and 13B, a Circulation Operation includes operation of one or more elevator cars 124 within hoistways 102 having more than one shared transfer station 126. As such, when a group of two or more hoistways 102 includes two or more horizontal transfer systems 126 at different landings or heights, elevator system 10 may be operated by circulating elevator cars 124 in a pattern as illustrated by arrows 128 in FIGS. 13A and 13B. In some embodiments, more than one pattern may overlap or share a portion of the circuit, and one or more cars may be switched between the circuits.

Transfer stations 126 may be temporary or permanent, and cars 124 may be directed on excursions outside circulation path 128 to serve "dead ends" in system 10 that are not on circulation path 128. As such, operation in the circulation system provides high throughput and increased time efficiency due to little or no conflict between movement of multiple cars 124 within the circulation path 128.

Figure 14:
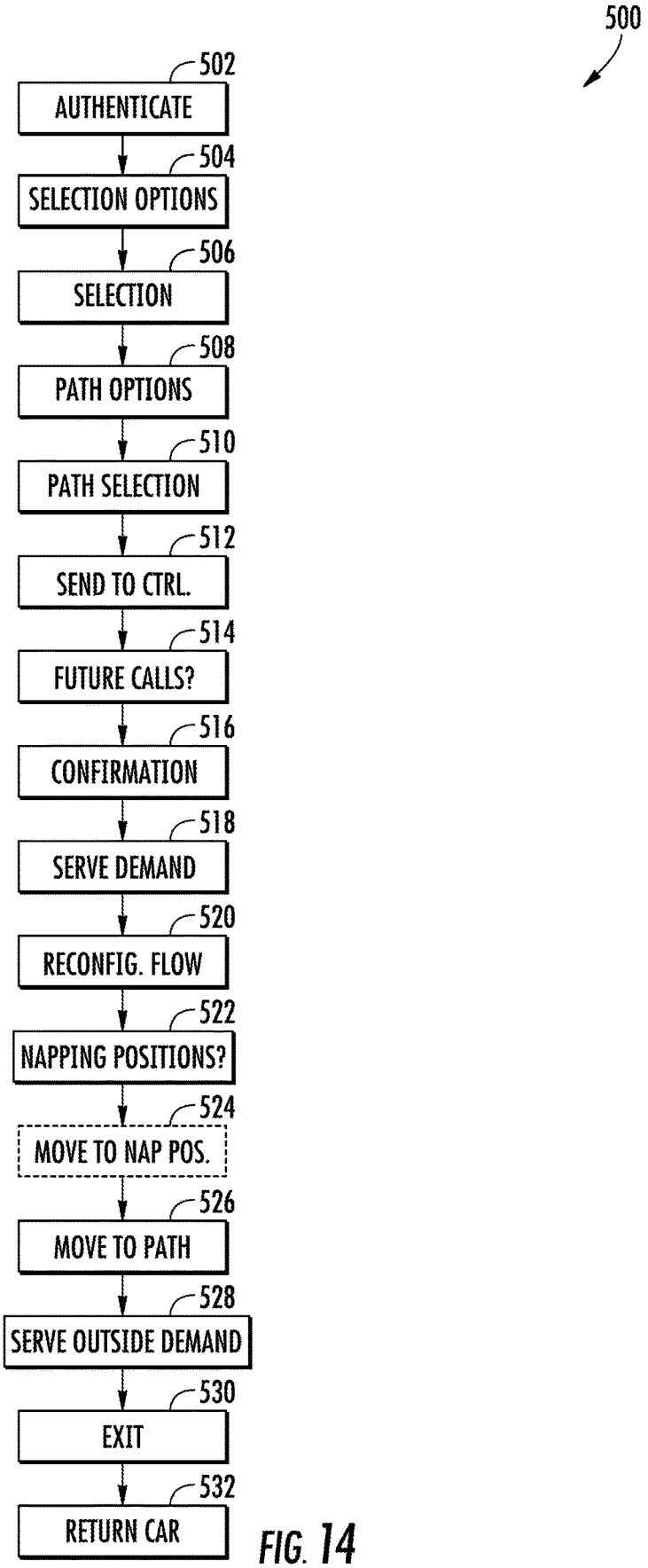
FIG. 14 depicts a control diagram of an exemplary fifth mode of operation that may be used with the system shown in FIGS. 12, 13A, and 13B.

FIG. 14 illustrates an exemplary control method or operation 500 for the Circulation Operation. In the exemplary embodiment, control operation 500 includes authorizing and/or authenticating the mode initialization at step 502. For example, a user may be required to input a login code or engage a key switch at control terminal 58 before the Circulation Mode is enabled or initialized.

Once enabled, at step 504, car circulation selection parameters/options are provided. The selection options may include: (i) number of circulation paths 128; (ii) which or how many cars 124 will be utilized in circulation path(s) 128; which or how many hoistways 102 will be utilized for circulation path(s) 128 (at least two). At step 506, a desired selection request is determined, for example, by user input into control terminal 58. However, one of the previously described controllers may automatically determine the desired selection request based on predetermined parameters. At step 508, circulation path options (i.e., shape and location of circulation path 128) may be generated, for example, by the user. Alternatively, or additionally, controller 46, 58 may provide various circulation path configurations to the user. At step 510, one or more desired circulation paths 128 are determined.

At step 512, the selection request may be sent to the controller, which may then determine if future service calls may be made during the operation of the selected Circulation Operation at step 514. At step 516, the controller may then send a signal to control terminal 58 to provide confirmation or denial of the requested operation. A confirmation may include the ETA of the selected elevator cars 124 to the designated circulation path 128.

If the desired operation is confirmed, at step 518, the controller directs the elevator cars 124 to service any demand (e.g., pick up or unload passengers) existing previous to the initialization of the Circulation Mode. At this point, group supervisor the controller may no longer assign calls to the selected elevator cars 124, and may no longer assign any call to additional cars 14 that must encroach on circulation path 128.

At step 520, the controller reconfigures the flow pattern of the remaining elevator cars 14 operating in other modes to avoid traversing the circulation path 128. At step 522, the controller determines if napping positions (i.e., temporary holding positions) are necessary for cars 14 that would interfere with circulation path 128. If required, at step 524, the controller directs cars 14 to the determined napping positions (e.g., car, lane, floor). At step 526, the controller directs the selected elevator cars 124 to their designated circulation path 128 for utilization by passengers. As such, elevator cars 124 are subsequently circulated in a single direction (i.e., clockwise or counter clockwise) to serve calls. If necessary, at step 528, the controller directs one or more elevator cars 124 out of circulation path 128 to serve demand of areas that are not served by path 128 (e.g., dead ends). Additionally, where circulation patterns overlap (e.g., FIG. 13A), cars in the overlapping areas may be assigned by the controller to switch from one circuit to another.

To return the selected cars 124 to a different service, at step 530, the controller generates a signal to exit the Circulation Operation (e.g., in response to a user unlock signal, or predetermined time-lapse). At step 532, the controller may confirm elevator cars 124 have been unloaded (e.g., by load-weight sensor 52), and direct cars 124 to return to another operational mode (e.g., a normal group service mode).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A ropeless elevator system comprising:

a plurality of elevator cars configured to travel in a hoistway having at least one lane;

a propulsion system to impart force to each elevator car of the plurality of elevator cars; and a controller configured to operate in an in-group mode where the plurality of elevator cars perform service demands, and to selectively operate in an out-of-group mode where at least one selected elevator car of the plurality of elevator cars performs a predetermined task and is prevented from performing the in-group mode service demands;

wherein the hoistway is partially constructed and is configured for use in a building under construction.

2. The ropeless elevator system of claim 1, wherein the propulsion system is a linear propulsion system comprising:

a primary portion mounted in the hoistway, the primary portion comprising a plurality of motor segments; and a plurality of secondary portions, wherein at least one secondary portion of the plurality of secondary portions is mounted to one elevator car of the plurality of elevator cars.

3. The ropeless elevator system of claim 1, wherein in the out-of-group mode the controller is programmed to:

reserve at least two designated, non-overlapping areas on the hoistway;

allow elevator car traffic that must go through the designated area to serve the service demands assigned thereto prior to switching to the out-of-group mode; and direct at least one selected car to each designated area of the at least two designated areas.

4. The ropeless elevator system of claim 1, wherein the at least one lane is a plurality of lanes, and wherein in the out-of-group mode the controller is programmed to:

define a one-way circulation path around the plurality of lanes, the one-way circulation path configured to move the at least one selected elevator car in an upward direction, a horizontal direction, and a downward direction; and assign the at least one selected elevator car to the one-way circulation path for circulation exclusively therein during at least a portion of the out-of group mode.

5. The ropeless elevator system of claim 4, wherein in the out-of-group mode the controller is further programmed to:

selectively remove the at least one selected elevator car from the one-way circulation path to serve a demand at a location that is not on the one-way circulation path; and return the at least one selected elevator car to the one-way circulation path after the demand has been served.

6. The ropeless elevator system of claim 1, further comprising:

a control terminal in signal communication with the controller, the control terminal configured to enable authorized personnel to switch the elevator system between the in-group mode and the out-of-group mode.

7. A ropeless elevator system comprising:

a plurality of elevator cars configured to travel in a hoistway having at least one lane;

a propulsion system to impart force to each elevator car of the plurality of elevator cars; and a controller configured to operate in an in-group mode where the plurality of elevator cars perform service demands, and to selectively operate in an out-of-group mode where at least one selected elevator car of the plurality of elevator cars performs a predetermined task and is prevented from performing the in-group mode service demands;

wherein in the out-of-group mode the controller is programmed to:

receive schedule information for future use of the elevator system; and devise, based on the received schedule information, a predefined path for the at least one selected elevator car such that the at least one selected elevator car meets a demand of the future use with minimal conflict between selected elevator cars.

8. The ropeless elevator system of claim 7, wherein in the out-of-group mode the controller is further programmed to:

announce the beginning of the future use; and move the at least one selected elevator car to a predetermined start position.

9. A ropeless elevator system comprising:

a plurality of elevator cars configured to travel in a hoistway having at least one lane;

a propulsion system to impart force to each elevator car of the plurality of elevator cars; and a controller configured to operate in an in-group mode where the plurality of elevator cars perform service demands, and to selectively operate in an out-of-group mode where at least one selected elevator car of the plurality of elevator cars performs a predetermined task and is prevented from performing the in-group mode service demands;

wherein in the out-of-group mode the controller is programmed to:

assign a specific task to the at least one selected elevator car;

receive information regarding operational constraints and capabilities of the at least one selected elevator car assigned to the specific task; and perform the specific task by operating the at least one selected elevator car in a predetermined manner within the received operational constraints and capabilities.

10. The ropeless elevator system of claim 9, wherein the at least one selected elevator car is at least one of a winch car having a winch configured to pull a load, a container car configured to couple to a load, a long object puller configured move an object hanging beneath the long object puller, and an elevator car having elongated secondaries.

11. The ropeless elevator system of claim 9, wherein the at least one selected elevator car is at least two selected elevator cars, and wherein in the out-of-group mode the controller is programmed to:

assign a specific task to the at least two selected elevator cars;

move the at least two selected elevator cars to a preparation area such that the at least two selected elevator cars can be prepared to perform the specific task; and perform the specific task by simultaneously operating the at least two selected elevator cars in collaboration and in a predetermined manner within the received operational constraints and capabilities.

12. The ropeless elevator system of claim 11, wherein the specific task is moving a load horizontally.

13. A method of controlling a ropeless elevator system comprising a plurality of elevator cars configured to travel in a hoistway having at least one lane and a propulsion system to impart force to each elevator car of the plurality of elevator cars, the method comprising:

operating in an in-group mode where the plurality of elevator cars perform service demands; and selectively operating in an out-of-group mode where at least one selected elevator car of the plurality of elevator cars performs a predetermined task and is prevented from performing the in-group mode service demands;

wherein the hoistway is partially constructed and is configured for use in a building under construction.

14. The method of claim 13, wherein operating in the out-of-group mode further comprises:

reserving at least two designated areas on the hoistway;

allowing elevator car traffic that must go through the designated area to serve the service demands assigned thereto prior to switching to the out-of-group mode; and directing at least one selected car to each designated area of the at least two designated areas.

15. The method of claim 13, wherein the at least one lane is a plurality of lanes, and wherein operating in the out-of-group mode comprises:

defining a one-way circulation path around the plurality of lanes, the one-way circulation path configured to move the at least one selected elevator car in an upward direction, a horizontal direction, and a downward direction; and assigning the at least one selected elevator car to the one-way circulation path for circulation exclusively therein during the out-of group mode.

16. A method of controlling a ropeless elevator system comprising a plurality of elevator cars configured to travel in a hoistway having at least one lane and a propulsion system to impart force to each elevator car of the plurality of elevator cars, the method comprising:

operating in an in-group mode where the plurality of elevator cars perform service demands; and selectively operating in an out-of-group mode where at least one selected elevator car of the plurality of elevator cars performs a predetermined task and is prevented from performing the in-group mode service demands;

wherein operating in the out-of-group mode further comprises:

receiving schedule information for future use of the elevator system; and devising, based on the received schedule information, a predefined path for the at least one selected elevator car such that the at least one selected elevator car meets a demand of the future use with minimal conflict between selected elevator cars.

17. A method of controlling a ropeless elevator system comprising a plurality of elevator cars configured to travel in a hoistway having at least one lane and a propulsion system to impart force to each elevator car of the plurality of elevator cars, the method comprising:

operating in an in-group mode where the plurality of elevator cars perform service demands; and selectively operating in an out-of-group mode where at least one selected elevator car of the plurality of elevator cars performs a predetermined task and is prevented from performing the in-group mode service demands;

wherein operating in the out-of-group mode further comprises:

assigning a specific task to the at least one selected elevator car;

receiving information regarding operational constraints and capabilities of the at least one selected elevator car assigned to the specific task; and performing the specific task by operating the at least one selected elevator car in a predetermined manner within the received operational constraints and capabilities.

18. The method of claim 17, wherein the at least one selected elevator car is at least two selected elevator cars, and wherein operating in the out-of-group mode comprises:

assigning a specific task to the at least two selected elevator cars;

moving the at least two selected elevator cars to a preparation area such that the at least two selected elevator cars can be prepared to perform the specific task; and performing the specific task by simultaneously operating the at least two selected elevator cars in collaboration and in a predetermined manner within the received operational constraints and capabilities.

19. The method of claim 18, wherein operating in the out-of-group mode further comprises:

selectively removing the at least one selected elevator car from the one-way circulation path to serve a demand at a location that is not on the one-way circulation path; and returning the at least one selected elevator car to the one-way circulation path after the demand has been served.

20. A method of controlling a ropeless elevator system comprising a plurality of elevator cars configured to travel in a hoistway having a plurality of lanes and a propulsion system to impart force to each elevator car of the plurality of elevator cars, the method comprising:

operating in an in-group mode where the plurality of elevator cars perform service demands; and selectively operating in a first out-of-group mode, a second out-of-group mode, a third out-of-group mode, a fourth out-of-group mode, and a fifth out-of-group mode where at least one selected elevator car of the plurality of elevator cars performs a predetermined task and is prevented from performing the in-group mode service demands, wherein operating in the first out-of-group mode comprises:

reserving at least two designated areas on the hoistway;

allowing elevator car traffic that must go through the designated area to serve the service demands assigned thereto prior to switching to the out-of-group mode; and directing at least one selected car to each designated area of the at least two designated areas;

wherein operating in the second out-of-group mode comprises:

receiving schedule information for future use of the elevator system; and devising, based on the received schedule information, a predefined path for the at least one selected elevator car such that the at least one selected elevator car meets a demand of the future use with minimal conflict between selected elevator cars;

wherein operating in the third out-of-group mode comprises:

assigning a specific task to the at least one selected elevator car;

receiving information regarding operational constraints and capabilities of the at least one selected elevator car assigned to the specific task; and performing the specific task by operating the at least one selected elevator car in a predetermined manner within the received operational constraints and capabilities;

wherein operating in the fourth out-of group mode comprises:

assigning a specific task to at least two selected elevator cars;

moving the at least two selected elevator cars to a preparation area such that the at least two selected elevator cars can be prepared to perform the specific task; and performing the specific task by simultaneously operating the at least two selected elevator cars in collaboration and in a predetermined manner within the received operational constraints and capabilities;

wherein operating in the fifth out-of-group mode comprises:

defining a one-way circulation path around the plurality of lanes, the one-way circulation path configured to move the at least one selected elevator car in an upward direction, a horizontal direction, and a downward direction; and assigning the at least one selected elevator car to the one-way circulation path for circulation exclusively therein during the out-of group mode.

* * * * *